United States Patent [19]

Richer

[11] 4,078,602

[45] Mar. 14, 1978

[54] HEAT EXCHANGER FOR RECOVERING WASTE HEAT

[75] Inventor: Robert J. Richer, Milwaukee, Wis.

[73] Assignee: Olla Enterprises, Inc., Milwaukee, Wis.

[21] Appl. No.: 751,273

[22] Filed: Dec. 17, 1976

[51] Int. Cl.[2] ..... G05D 23/00

[52] U.S. Cl. ..... 165/32; 165/39; 165/76; 165/DIG. 2

[58] Field of Search ..... 165/32, 39, 54, 76, 165/78, 95, 122, 126, 129, 130, DIG. 2

[56] References Cited

U.S. PATENT DOCUMENTS

| | | | |
|---|---|---|---|
| 2,882,023 | 4/1959 | Rizzo | 165/39 |
| 3,124,197 | 3/1964 | Funk | 165/DIG. 2 |
| 3,884,292 | 5/1975 | Pessolano et al. | 165/39 |
| 4,034,482 | 7/1977 | Briscoe | 165/DIG. 2 |

*Primary Examiner*—Edgar W. Geoghegan

*Attorney, Agent, or Firm*—Cyril M. Hajewski

[57] ABSTRACT

A heat exchanger for receiving heat from hot exhaust gases flowing through the flue of a furnace or boiler. The exhaust gases are directed through a heat box which contains a plurality of tubes. A blower blows room air through the tubes whenever hot gases are flowing through the flue and the heat in these gases flows about the tubes to warm the air flowing through the tubes and the warm air is directed to a room to be heated. The exterior of the tubes are exposed to the exhaust gases and these become dirty and must be cleaned. To facilitate this operation the present invention provides for constructing the tubes into an assembly which is removable as a unit from the heat box and is secured to the box by snap moldings which snap over the open edges of the heat box and the tube assembly to not only secure the tube assembly to the heat box but to seal the heat box to prevent the escape of any gases.

12 Claims, 6 Drawing Figures

Fig. 3
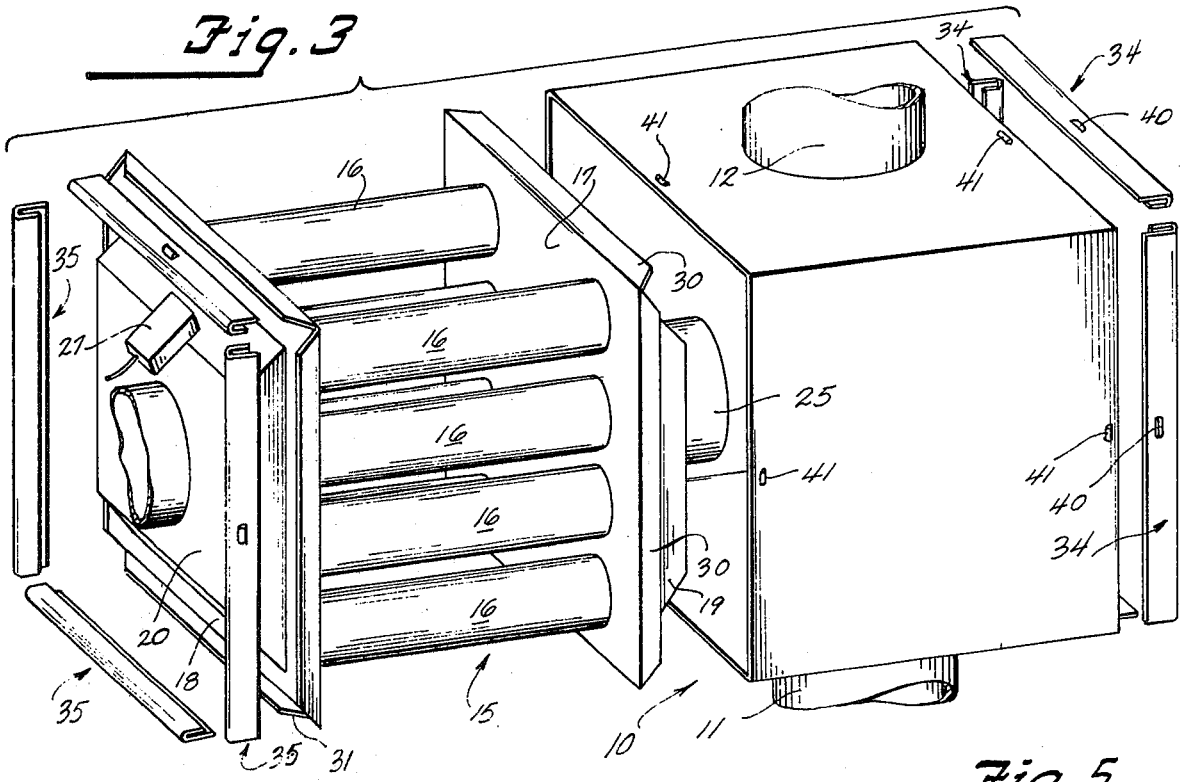
Fig. 5
Fig. 4
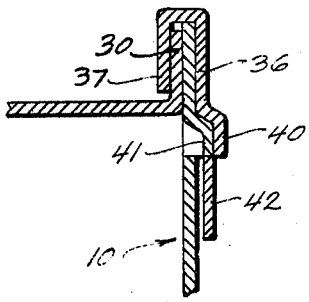
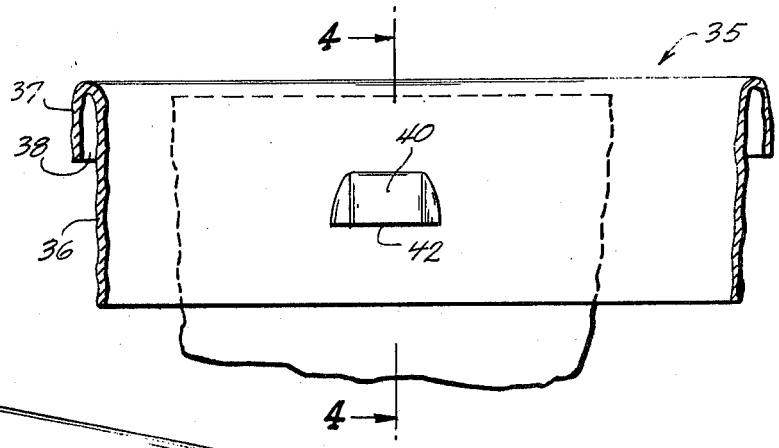
Fig. 6
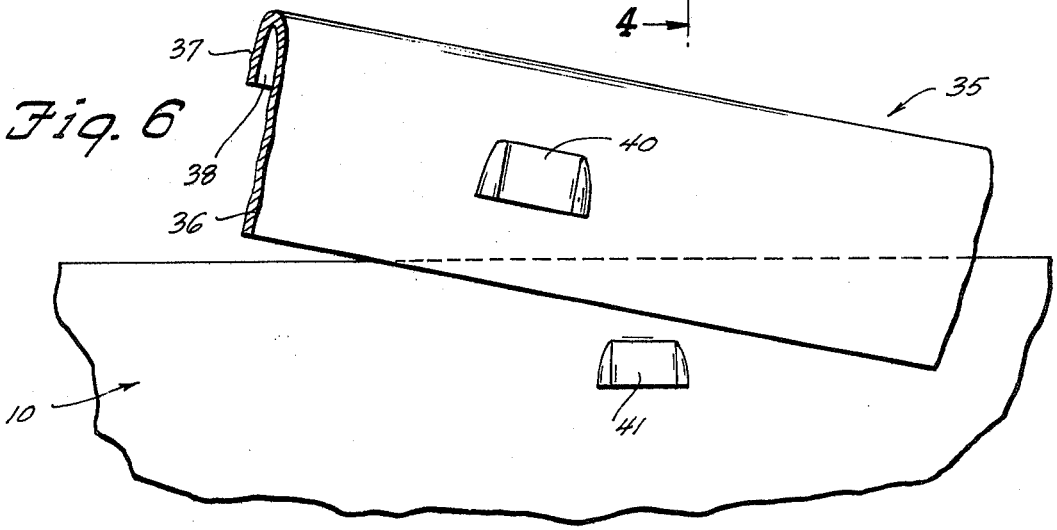

HEAT EXCHANGER FOR RECOVERING WASTE HEAT

BACKGROUND OF THE INVENTION

Heat exchangers for recovering heat which would otherwise be wasted from flue or exhaust gases are well known. In these prior art devices the flue gases flow past tubes through which the air to be heated is flowing and the hot flue gases heat the air which may then be used for heating either the furnace room or some other room. A problem with these waste heat recovering systems lies in the fact that the exterior surfaces of the tubes containing the air to be heated are exposed to the hot exhaust gases and therefore become dirty from soot and carbon which greatly detracts from the efficiency of the unit. As a result, they must be frequently cleaned.

The cleaning of such tubing in the previous waste heat recovery systems has been a difficult task because of their inaccessibility and their awkward location. This problem was recognized and an effort made to solve it in U.S. Pat. No. 2,882,023 issued to Salvatore Rizzo on Apr. 14, 1959 inasmuch as the tubes for carrying the air to be heated are removable as a unit from the heat box for cleaning. However, because of the removability of the tubes from the heat box, inadequate sealing results, so that the exhaust gases can escape into the furnace room and into the air being heated as well. The units are made of sheet metal and tight fits cannot be obtained without the use of positive seals to prevent the escape of the exhaust gases.

The present invention solves this problem by constructing the fresh air tubes into a unitary assembly that can be slid into and out of the heat box as a unit while also providing easily installed and removable seals that seal the tubes from the interior of the heat box and seal the heat box itself so that hot exhaust gases from the furnace or boiler cannot escape except through the chimney.

A general object of the present invention is to provide an improved heat exchanger for recovering heat from the flue or exhaust gases of a heater which would otherwise be wasted.

A further object of the present invention is to provide an improved heat exchanger for extracting heat from flue gases which can be readily disassembled for cleaning and yet is tightly sealed to prevent any escape of the hot gases from the flue.

SUMMARY OF THE INVENTION

A heat box is installed in the flue of a furnace, boiler or space heater of any kind so that the hot exhaust gases must flow through the heat box on their way to the chimney. A plurality of tubes are passed through the heat box and the air to be heated is passed through the tubes while the hot exhaust gases are passing through the heat box. The heat from the exhaust gases serves to heat the air flowing through the tubes and the warm air is directed to the space which it is to heat. In a preferred embodiment the air to be heated is blown through the tubes by a fan that is energized automatically by a thermostat whenever the temperature in the heat box reaches a predetermined temperature, such as, for example, 250° F.

It is imperative that the tubes and heat box be kept relatively clean in order to maintain the efficiency of the unit. Moreover, it is absolutely essential that the exhaust gases do not escape from the heat box either into the tubes or into the atmosphere of the room in which the unit is located. To this end the present invention provides for building the plurality of tubes into a unitary tube assembly which may be easily slid into and out of the heat box for maintenance purposes. In addition, snap moldings are provided that can be snapped into place in moments for effectively sealing the heat box to prevent the escape of any of the heater gases except through the flue.

BRIEF DESCRIPTION OF THE DRAWING

FIG. 3 is a perspective exploded view of the heat exchanger shown in FIG. 1 to depict the assembly of the parts to form the completed structure;

FIG. 4 is a detail sectional view taken along the plane represented by the line 4—4 in FIG. 5 and showing the assembly of a snap molding to the heat box for sealing the unit;

FIG. 5 is a detail fragmentary elevational view of a snap molding that is used for sealing the unit; and FIG. 6 is a fragmentary elevational view showing a snap molding as it is being assembled to the heat box.

DESCRIPTION OF THE PREFERRED EMBODIMENT

Figure 1:
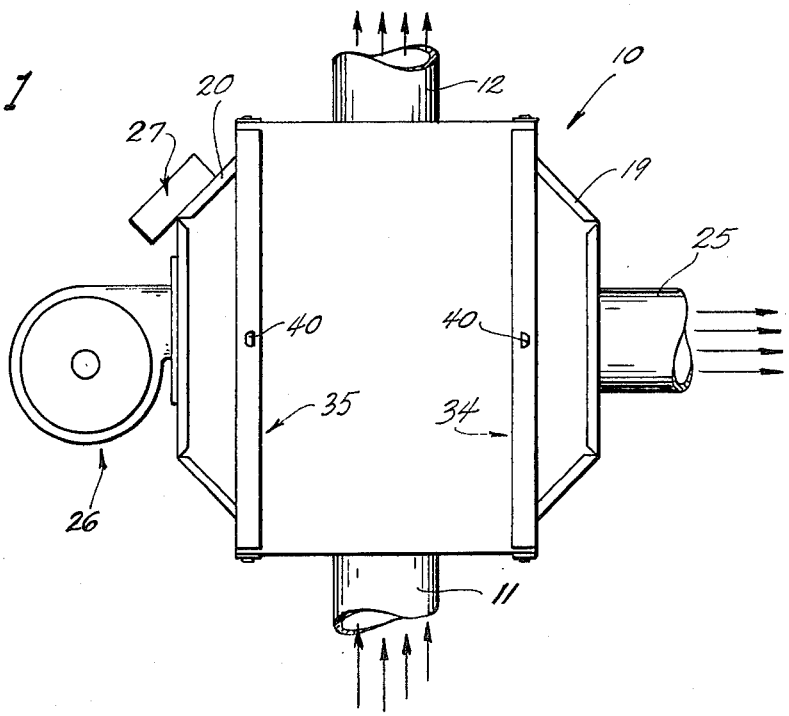
FIG. 1 is a plan view of a heat exchanger for recovering waste heat from flue gases constructed in accordance with the teachings of the present invention.

Reference is now made more particularly to the drawings and specifically to FIG. 1 thereof which discloses a heat exchanger incorporating the features of the present invention. The heat exchanger there shown comprises a heat box or cabinet generally identified by the reference numeral 10 and which is adapted to receive the hot exhaust gases from a furnace, boiler or other heating device (not shown). To this end, the hot gases from the heating device flow through a flue 11 into the heat box 10 and are exhausted therefrom into a flue 12 which leads to a suitable chimney for creating the desired draft in the heater. Contained within the heat box 10 is a tube assembly illustrated in FIG. 3 and generally identified by the reference numeral 15. The tube assembly 15 comprises a plurality of tubes 16 that are mounted parallel to each other and in spaced relationship. The illustrated embodiment shows eight such tubes 16 but it should be understood that a different number of tubes 16 may be provided. The tubes 16 are secured at one end to a plate 17 and at their opposite ends to a plate 18.

Figure 2:
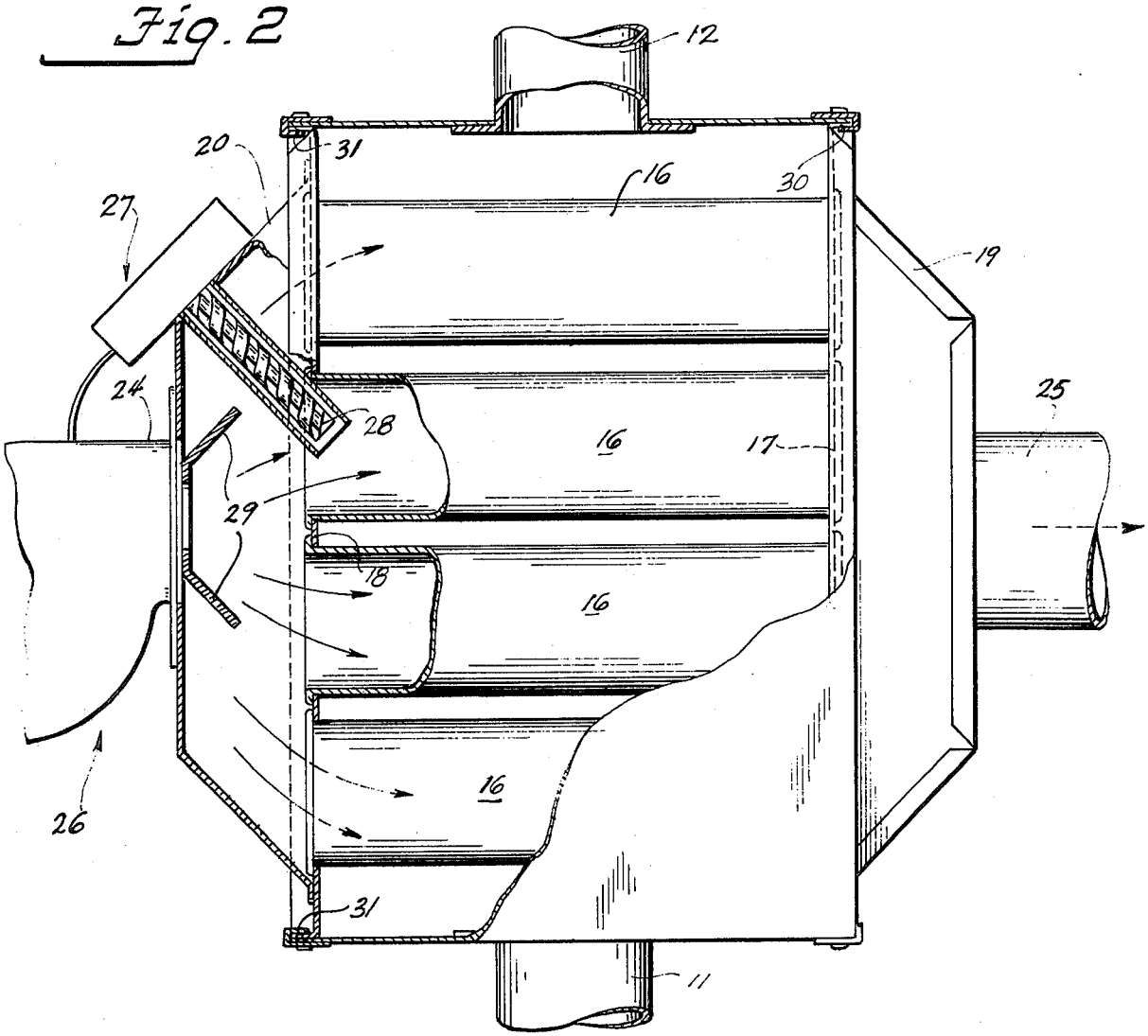
FIG. 2 is an enlarged plan view of the heat exchanger shown in FIG. 1 with parts broken away to illustrate the interior construction.

As best shown in FIG. 2, the ends of the tubes 16 are not closed by the plates 17 and 18 but open on one side into a bonnet 19 and at the opposite side into a bonnet 20. To this end, the plates 17 and 18 are each provided with a number of holes equal in number to the number of tubes and the tubes are secured in alignment with these holes so that their ends are completely open. The bonnet 19 is secured to the plate 17 while the bonnet 20 is secured to the plate 18. Thus, the tubes 16, the plates 17 and 18 and the bonnets 19 and 20 form a complete unitary assembly which can be slid into and out of the heat box 10 as a unit with the bonnets 19 and 20 extending outwardly of the heat box 10, with a duct 25 extending outwardly of the bonnet 19. The ends of the tubes 16 are sealed to the plates 17 and 18 so that flue gases flowing through the heat box 10 cannot enter into the air flowing through the tubes 16.

An electric motor activated fan generally identified by the reference numeral 26 is mounted on the bonnet 20 and is regulated by a thermostat 27 that is mounted on the bonnet 20 and is operated by the heat within the tubes 16. To this end the thermostat includes a bimetallic element 28 as shown in FIG. 2. The bimetallic element 28 extends through the bonnet 20 and into one of the tubes 16. When the heat in the tube 16 reaches a predetermined temperature, such as, for example, 250° F, the thermostat 27 will complete a circuit for energizing the electric fan 26. The fan 26 then blows room air into the bonnet 20 and thence the eight tubes 16. In order to better disperse the air from the fan 26 to the eight tubes 16 a pair of baffle plates 29 are mounted at the exhaust of the fan 26 within the bonnet 20. The baffle plates direct the air toward all eight tubes 16 so that a substantially uniform amount of air flows through each of the tubes 16.

Since the hot exhaust gases from the heating device (not shown) are flowing through the flue 11 into the heat box 10, the hot gases are surrounding the tubes 16 to heat the air flowing through the tubes. This warm air is then directed from the tubes 16 into the bonnet 19 and thence through the duct 25 which will be connected to the space that is to be heated. Thus, the heat is extracted from the exhaust gases flowing through the flue 11 for warming air which may be utilized to advantage for heating a space. In the absence of such heat exchanger, the heat would flow into the chimney and be wasted.

As previously mentioned, the exhaust gases flowing about the tubes 16 will deposit soot and carbon on the exterior of the tubes 16 as well as associated plates 17 and 18. In order to gain access to these tubes for maintenance purposes, it is desirable that they be readily removable from the heat box 10. The present invention facilitates such removability by constructing the tube assembly 15 which may be slid as a unit out of the heat box 10 and slid back into it.

However, the exhaust gases flowing through the heat box 10 must be securely sealed from the room air so that they cannot escape from the heat box 10 and cannot enter into the room air flowing through the tubes 16. In order to provide such effective seal a sealing strip 30 is provided on each edge of the plate 17 to extend perpendicularly therefrom toward the bonnet 19. In like manner, a sealing strip 31 is provided on each edge of the plate 18 to extend perpendicularly therefrom toward the bonnet 20. These sealing strips 30 and 31 are best shown in FIG. 3.

When the tube assembly 15 is inserted into the heat box 10, the outer edges of the sealing strips 30 will lie flush with the right edges of the heat box 10 as viewed in FIG. 3. Similarly, the outer edges of the sealing strips 31 will lie flush with the outer edges of the left side of the heat box 10 as viewed in FIG. 3. When the tube assembly 15 is thus inserted into the heat box 10, the sealing of these edges is completed by placing a snap molding 34 in position to extend over each of the sealing strips 30 and the edges of the heat box 10. Identical snap moldings 35 are provided on the opposite side of the heat box 10 for overlapping the edges of the heat box 10 and the sealing strips 31. Thus four snap moldings 34 and four snap moldings 35 are easily assembled to the unit to seal the heat box 10 to prevent the escape of any gases from it.

A detail view of the snap moldings 35 is shown in FIGS. 4, 5 and 6 and each of the snap moldings 34 and 35 comprise a flat strip 36 which is bent 180° to form another flat overlapping strip 37. The overlapping strip 37 is spaced a short distance from the flat strip 36 to form a space 38 between them and the sealing strips 30 and 31 and the wall of the heat box 10 occupy the space 38 as clearly shown in FIG. 4.

In order to retain the snap moldings 34 and 35 in assembled position, they are provided with indentations 40 that cooperate with identical identations 41 on the heat box 10. The indentations 40 on the wall 36 of the snap moldings 34 and 35 and the indentations 41 in the heat box 10 are placed in overlapping relationship as shown in FIG. 4 to lock the snap moldings 34 and 35 in position. When the indentations are in overlapping position as shown in FIG. 4, the wall 42 underneath the indentation 40 slides underneath the indentation 41 of the heat box 10 to hold the snap moldings in position as shown in FIG. 4. In order to release these snap locks, the snap moldings 34 and 35 may be moved longitudinally to move the wall 42 away from the indentation 41 so that the snap moldings may be released and removed from the assembly.

Thus, the sealing strips 30 and 31 engaged by the snap moldings 34 and 35 respectively make a tight sealed engagement with the walls of the heat box 10 to prevent the escape of any of the exhaust gases flowing into the heat box 10 either out of the box or into the air flowing through the tubes 16. Yet, although such tight effective seal is completed, the entire unit may be readily disassembled by simply moving the snap strips 34 and 35 a small distance longitudinally, such as about one-half inch, and then removing them from the unit. After these snap moldings are removed, the tube assembly 15 may be readily slid out of the heat box 10 for maintenance purposes.

From the foregoing detailed description of the illustrative embodiment of the invention set forth herein it will be apparent that there has been provided an improved heat exchanger for removing waste heat from exhaust gases of a heating device and utilizing such heat to advantage for heating a space. The heat exchanger is designed so that the exhaust gases flowing through the heat exchanger are securely confined so that they cannot escape into the air of the room occupied by human beings. On the other hand, although such effective seal is obtained, the unit may be readily disassembled for maintenance purposes and reassembled again.

Although the illustrative embodiment of the invention has been described in considerable detail for the purpose of disclosing a practical operative arrangement by means of which the invention may be practiced advantageously, it is to be understood that the particular heat exchanger illustrated and described is intended to be illustrative only and that the various novel characteristics of the invention may be incorporated in other structural forms and methods without departing from the spirit and scope of the invention as defined in the subjoined claims.

The principles of this invention having now been fully explained in connection with the foregoing description, I hereby claim as my invention:

1. In a heat exchanger for extracting heat from the exhaust gases of a heating device before such exhaust gases flow out of a chimney; a heat box connected so that the exhaust gases from the heating device flow through said heat box before they are exhausted through the chimney; a tube assembly formed of a plurality of tubes supported together to form a unitary assembly that may be slid into and out of said heat box, said tubes being sealed from the interior of the heat box so that the exhaust gases in the heat box cannot enter said tubes, a fan driven by an electric motor and dispersed to force air through said tubes so that the air flowing through said tubes will be heated by the heat in the exhaust gases flowing through said heat box to provide warm air for heating purposes; and sealing means in engagement with said tube assembly and said heat box for securely sealing said heat box to prevent the escape of exhaust gases therefrom.

2. A heat exchanger according to claim 1, wherein said tube assembly includes a pair of plates with each plate having a plurality of holes corresponding in number to the number of tubes in said tube assembly, and each of said tubes has its first end in alignment with one of the holes in the first of said plates and is secured to said first plate, and each of said tubes has its opposite end in alignment with a complementary hole in the second of said plates and is secured to said second plate so that the air is free to flow through said tubes, said plates fitting inside said heat box.

3. A heat exchanger according to claim 1, including a thermostat in said heat box connected to control the flow of electricity to the motor of said fan to energize said motor when the interior of said heat box is heated to a predetermined temperature.

4. A heat exchanger according to claim 3, wherein said thermostat includes a bimetallic element located in one of said tubes so that the temperature in said tubes will regulate the operation of the fan motor.

5. A heat exchanger according to claim 2, including a thermostat in said heat box connected to control the flow of electricity to the motor of said fan to energize said motor when the interior of said heat box is heated to a predetermined temperature.

6. A heat exchanger according to claim 2, including sealing strips extending laterally from each edge of both of said plates so that said sealing strips will be flush with the walls of said heat box when said tube assembly is in said heat box, and said sealing means engages said sealing strips and the walls of said heat box for sealing the heat box and securing said tube assembly in position in said heat box.

7. A heat exchanger according to claim 6 wherein said sealing means comprises snap moldings that slide over said sealing strips and the walls of the heat box to effect the seal.

8. A heat exchanger according to claim 1, including sealing strips extending from both ends of said tube assembly so that said sealing strips will be flush with the walls of said heat box when said tube assembly is in said heat box, and said sealing means engages said sealing strips and the walls of said heat box for sealing the heat box and securing said tube assembly in position in said heat box.

9. A heat exchanger according to claim 8, wherein said sealing means comprises snap moldings that slide over said sealing strips and the walls of the heat box to effect the seal.

10. A heat exchanger according to claim 9, including a lock on each of said snap moldings for cooperation with complementary locks on the walls of said heat box for removably locking said snap moldings in position.

11. In a heat exchanger for extracting heat from the exhaust gases of a heating device before such exhaust gases flow out of a chimney; a heat box connected so that the exhaust gases from the heating device flow through said heat box before they are exhausted through the chimney; a tube assembly formed of a plurality of tubes supported together to form a unitary assembly that may be slid into and out of said heat box, said tubes being sealed from the interior of the heat box so that the exhaust gases in the heat box cannot enter said tubes; a fan driven by an electric motor and dispersed to force air through said tubes so that the air flowing through said tubes will be heated by the heat in the exhaust gases flowing through said heat box to provide warm air for heating purposes; and a thermostat in said heat box connected to control the flow of electricity to said motor so that said motor is energized when the interior of said heat box is heated to a predetermined temperature.

12. A heat exchanger according to claim 11 wherein said thermostat includes a bimetallic element located in one of said tubes so that the temperature in said tube will regulate the operation of said motor.

* * * * *